US008720098B2

(12) United States Patent
Burress, Jr.

(10) Patent No.: US 8,720,098 B2
(45) Date of Patent: May 13, 2014

(54) TACTICAL PRECISION GRIP

(71) Applicant: Earl W. Burress, Jr., Las Vegas, NV (US)

(72) Inventor: Earl W. Burress, Jr., Las Vegas, NV (US)

( * ) Notice: Subject to any disclaimer, the term of this patent is extended or adjusted under 35 U.S.C. 154(b) by 0 days.

(21) Appl. No.: 13/679,778

(22) Filed: Nov. 16, 2012

(65) Prior Publication Data

US 2013/0125442 A1 May 23, 2013

Related U.S. Application Data

(60) Provisional application No. 61/562,978, filed on Nov. 22, 2011.

(51) Int. Cl.
*F41C 23/16* (2006.01)
*F41C 23/10* (2006.01)

(52) U.S. Cl.
CPC ..... *F41C 23/10* (2013.01)
USPC ..... 42/71.01; 89/1.42

(58) Field of Classification Search
USPC ..... 42/71.01, 71.02, 72, 7, 6; 89/1.42; 16/430; D22/108, 109, 104, 105, 117
See application file for complete search history.

(56) References Cited

U.S. PATENT DOCUMENTS

| | | | | |
|---|---|---|---|---|
| D199,064 | S * | 9/1964 | Barney | D22/104 |
| 4,638,582 | A | 1/1987 | Farrar | |
| 5,159,136 | A * | 10/1992 | Marsh | 42/71.01 |
| 5,857,279 | A | 1/1999 | De Oliveira Masina | |
| D410,988 | S | 6/1999 | Hines | |
| D439,628 | S | 3/2001 | Tugwell | |
| D479,571 | S * | 9/2003 | Benini | D22/108 |
| 6,804,907 | B1 | 10/2004 | Slobodkin | |
| 6,839,998 | B1 * | 1/2005 | Armstrong | 42/71.01 |
| 6,860,053 | B2 | 3/2005 | Christiansen | |
| 6,904,615 | B2 | 6/2005 | Kobe et al. | |
| D562,931 | S | 2/2008 | Szabo | |
| D600,309 | S | 9/2009 | Fitzpatrick et al. | |
| D600,310 | S | 9/2009 | Fitzpatrick et al. | |
| D639,889 | S | 6/2011 | Troy, Jr. | |
| 2010/0071244 | A1 * | 3/2010 | Fitzpatrick et al. | 42/71.01 |
| 2011/0107642 | A1 | 5/2011 | Godard | |
| 2012/0125189 | A1 * | 5/2012 | McLean, III | 89/132 |

FOREIGN PATENT DOCUMENTS

| | | |
|---|---|---|
| CA | 2 461 321 A1 | 9/2004 |
| EP | 0 108 031 A1 | 5/1984 |

* cited by examiner

*Primary Examiner* — Michael Carone
*Assistant Examiner* — Reginald Tillman, Jr.
(74) *Attorney, Agent, or Firm* — Richard C. Litman

(57) ABSTRACT

The tactical precision grip includes an elongate body having an upper mounting portion for mounting the grip to existing mounting hardware on a firearm. At least the sides and back of the body include anti-skid surfaces to prevent slip on the hold during operation. An upper depression is formed on the back of the body for placing a user's thumb, and the front of the body includes an elongate, vertical fingertip groove for placing the user's fingertips during shooting. The depression and the fingertip groove encourage user placement of the respective thumb and fingertips to minimize contact with the firearm grip, thereby enhancing trigger control and shooting accuracy.

15 Claims, 8 Drawing Sheets

TACTICAL PRECISION GRIP

CROSS-REFERENCE TO RELATED APPLICATION

This application claims the benefit of U.S. Provisional Patent Application Ser. No. 61/562,978, filed Nov. 22, 2011.

BACKGROUND OF THE INVENTION

1. Field of the Invention

The present invention relates to firearms, and particularly to a tactical precision grip for firearms that promotes reduced hand-to-grip contact to thereby enhance trigger control for long-range shooting precision.

2. Description of the Related Art

In the realm of firearms, any practiced shooter exercises several disciplines during the process of taking and completing the shot. For long-range targets, the shooter must align his/her body to a natural aiming position and ensure that the body is in a stable firing configuration for the weapon. The distance to target must be accurately assessed, taking into account the terrain and weather conditions. In non-ideal conditions, the aim must be adjusted accordingly. Conscious breath control is also very important when readying the shot. Normal breathing expands and contracts the chest cavity, which affects the movement of the rest of the body. If the shooter takes a shot while inhaling, the chest expansion can deviate the aim, causing the shot to miss. This is exacerbated with long-range targets because the slightest deviation in aim can greatly increase the margin of error. Hence, instructors advocate taking the shot during the natural pause after exhalation. There is about an eight-second window at this time, when the body is naturally immobile enough to ensure that the shot will hit where the shooter aims. Any longer will increase the likelihood of a missed shot due to lack of oxygen and the corresponding reaction from the body.

While all the above play an important role, one of the most fundamental disciplines involves trigger control for accurate shooting. Improper trigger control can moot all prior preparations. Ideally, the shooter should pull the trigger with even pressure throughout the start and completion of the shot. Moreover, the pull should be straight back. Jerking the trigger increases the chances of missed shots because it will most likely torque the weapon and offset the aim. In order to prevent such an occurrence, many shooters practice dry-firing their weapons and critically examine their trigger control.

Despite all the practice, the chances of missed shots still exist due to the manner in which one holds the grip of the firearm. Conventionally, the shooter wraps their fingers completely around the grip to tightly hold the weapon. While that may seem to be a stable manner of holding the weapon, the rest of the body plays a larger stabilizing role when taking a shot. For example, snipers favor the relaxed prone position, which is most stable, so that the butt of the sniper rifle rests against their shoulder to absorb recoil, their cheek rests against the side of the weapon, and the barrel rests against a combination of their non-trigger hand and a weapons stand, either standard issue or makeshift. In this position, the sniper holds the grip firmly, but the shoulder, cheek, stand, and non-trigger hand all play a role in stabilizing the weapon, more so than the trigger hand.

For long-range shooting precision, an alternative gripping technique is being proposed. This technique advocates minimizing trigger hand contact with the grip for better trigger control. In this technique, the rifle grip should be held by the thumb and fingertips. This places the hand in a better position for a straight back pull on the trigger, while minimizing the chances of weapon torque that usually occurs if the weapon is held too tightly with the conventional holding grip. Unfortunately, there does not appear to be any firearm grips that promote this technique. Most conventional grips or handles include ergonomic finger grooves and/or non-skid features for enhancing the hold from the user. None appears to advocate holding the grip with the thumb and fingertips.

In light of the above, it would be a benefit in the art of firearms and firearm accessories to provide a grip or handle that promotes being held by the thumb and fingertips for enhanced trigger control. Thus, a tactical precision grip solving the aforementioned problems is desired.

SUMMARY OF THE INVENTION

The tactical precision grip includes an elongate body having an upper mounting portion for mounting the grip to existing mounting hardware on a firearm. At least the sides and back of the body include anti-skid surfaces to prevent slip on the hold during operation. An upper depression is formed on the back of the body for placing a user's thumb, and the front of the body includes an elongate, vertical fingertip groove for placing the user's fingertips during shooting. The depression and the fingertip groove encourage user placement of the respective thumb and fingertips to minimize contact with the firearm grip, thereby enhancing trigger control and shooting accuracy.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
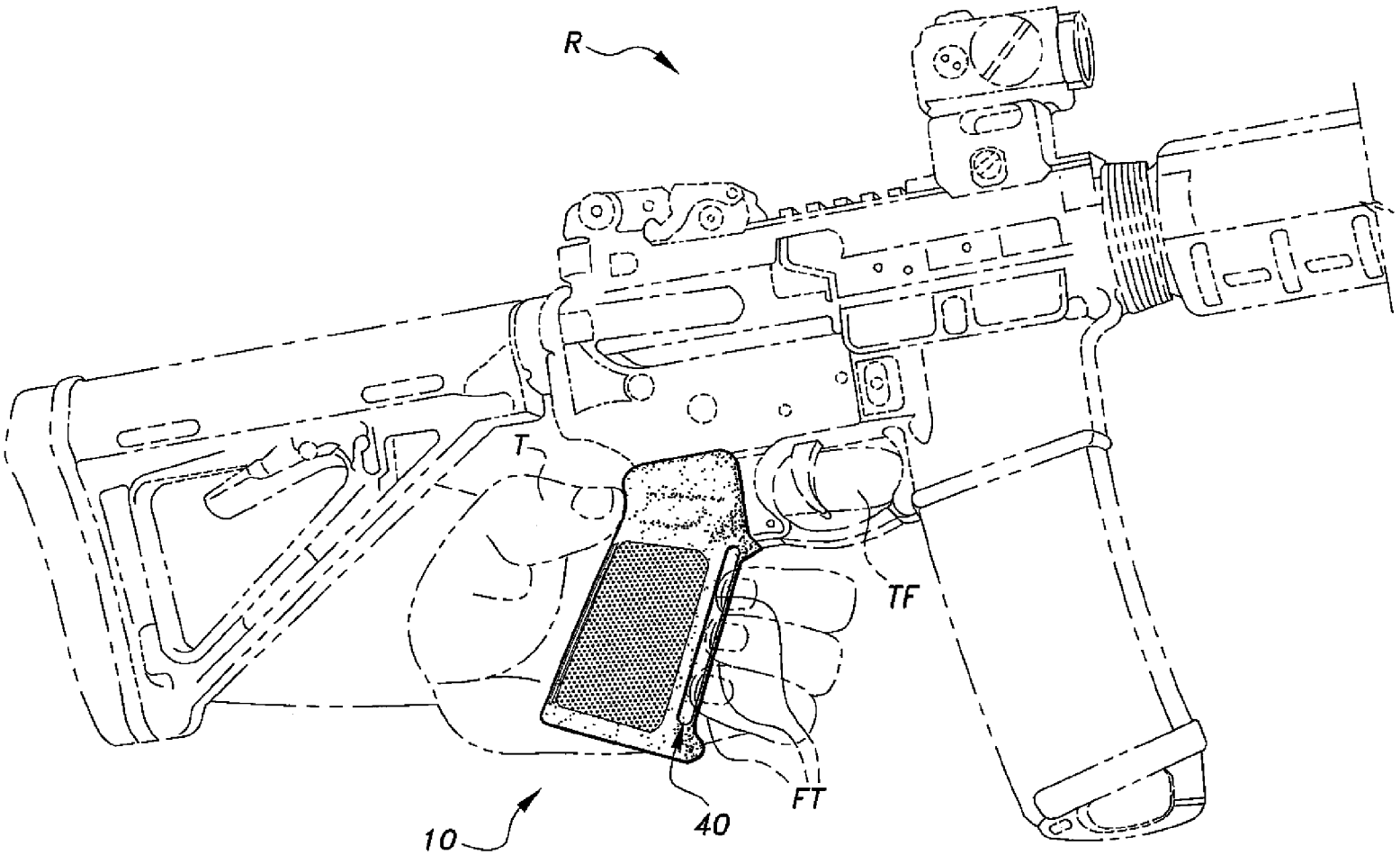
FIG. 1 is an environmental, perspective view of a tactical precision grip according to the present invention.
Figure 2:
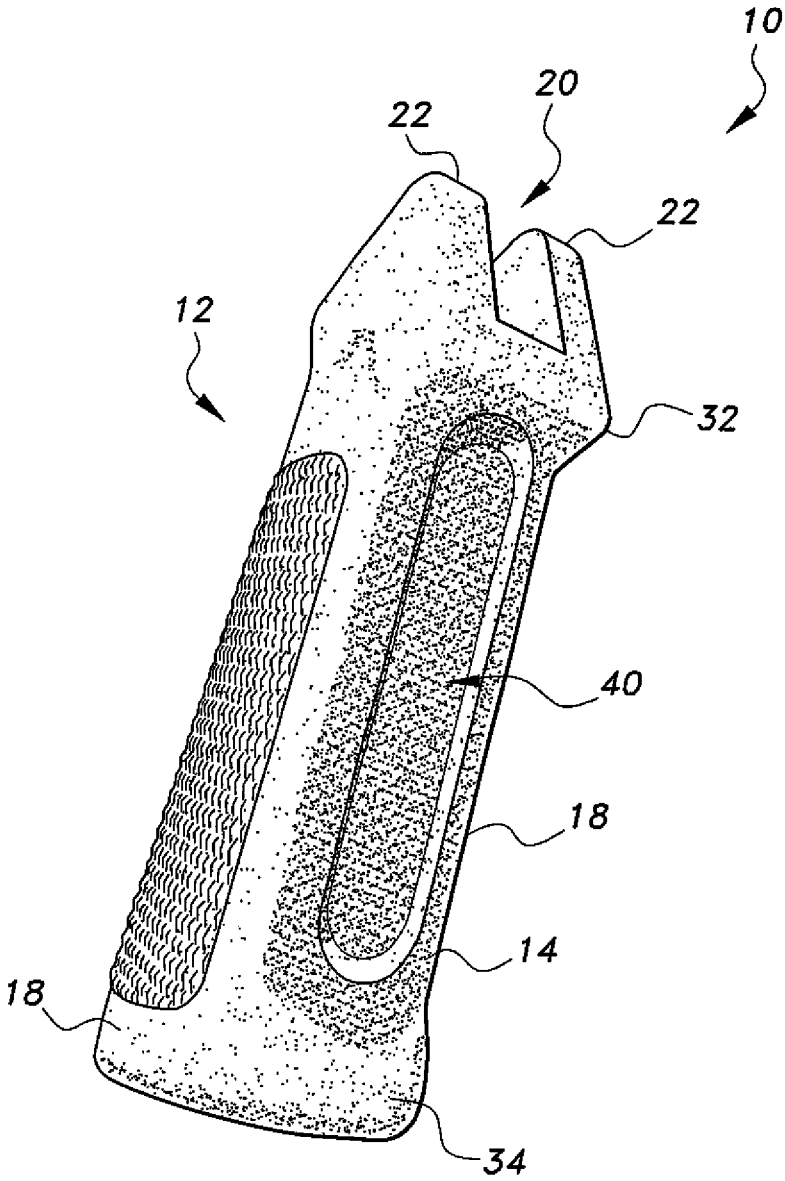
FIG. 2 is a perspective view of the tactical precision grip of FIG. 1.

The tactical precision grip, the first embodiment of which is generally referred to in the drawings by the reference number 10, provides features for encouraging the user to hold the grip by the thumb and fingertips. As shown in FIGS. 1-3A, the tactical precision grip 10 includes an elongate grip body 12 having a front 14, back 16, and opposing sides 18. The tactical precision grip 10 is preferably constructed from a lightweight, durable polymer that can withstand the rigors of combat and normal use. Alternatively, the tactical precision grip 10 can also be constructed from various metals, composites, natural materials (such as wood, ivory and pearl), and/or a combination thereof. The body 12 is preferably angled and contoured to conform to the natural grip and position of a user's hand. The upper portion of the body 12 is constructed for selectively mounting the tactical precision grip 10 onto existing mounting hardware of a firearm or rifle R. Also, the body 12 includes a hollow interior or compartment 28 that provides room for storing various accessories, such as extra or special ammunition, tools, batteries and the like, and provides access for a tool to attach or detach the tactical precision grip 10 from the firearm R. The bottom of the body 12 is normally covered by a removable cover, as is known in the art.

In order to mount the tactical precision grip 10, the upper portion of the body 12 includes a mounting recess 20 shaped to conform to the existing grip mounting hardware of the firearm R. A partition 30 between the recess 20 and the compartment 28 includes a through-hole or aperture 24 for a fastener used to securely mount the tactical precision grip 10. The mounting recess 20 is disposed between upper flanges 22 disposed on either side of the recess 20. One of the upper flanges 22 can include an elongate recess 26 for receiving a spring for the safety mechanism of the firearm R. The above mounting features described and shown are typical for an AR-15® rifle manufactured by Colt's Manufacturing Company, LLC. However, it is to be understood that the teachings thereof can be applied to other firearms having detachable grips.

Figure 3A:
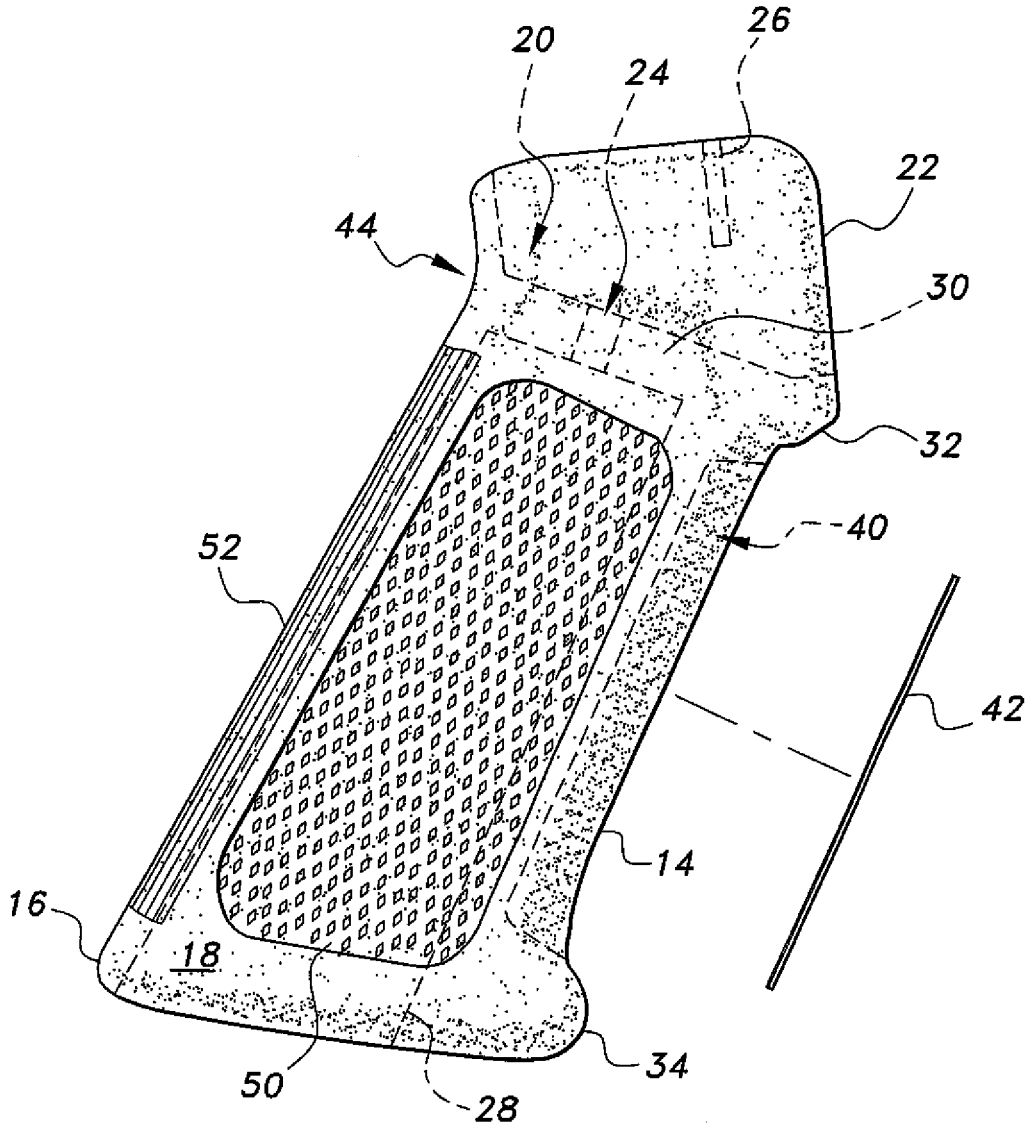
FIG. 3A is a side view of the tactical precision grip of FIG. 1, showing non-skid tape that can be applied to the fingertip groove.

The front 14 of the body 12 includes an upper protrusion or abutment 32 and a lower protrusion or abutment 34. The abutments 32, 34 define an area therebetween where the fingers of the hand normally reside. The front 14 also includes an elongate, vertical fingertip groove 40 extending between the upper and lower abutments 32, 34. The fingertip groove 40 provides a comfortable recess for the user's fingertips FT to rest, thereby encouraging the minimal grip contact technique discussed above. The depth of the fingertip groove 40 should be deep enough for the user to obtain a secure hold on the tactical precision grip 10 during use. To minimize slip, a strip of non-skid tape 42 can be installed in the fingertip groove 40, as shown in FIG. 3A. In addition to the vertical fingertip groove 40, the back 16 includes a contoured indention 44 for resting the thumb T of the user's hand. The indention 44 can extend around the sides 18 for normal placement of the thumb T. By placing the thumb T on the indention 44 and the fingertips FT in the fingertip groove 40 during firing conditions, minimal hand contact can be maintained, and the trigger finger TF is free to pull the trigger in the correct manner. Thus, trigger control can be enhanced with the aforementioned grip technique.

Various conditions, such as rain, snow, mud and sweat, can cause the user to easily lose hold of the tactical precision grip 10. To counter this, the tactical precision grip 10 includes anti-skid features, such as the patterned, knurled, or textured anti-skid surface 50 on the sides 18 of the body 12 and the patterned, knurled, or textured anti-skid surface 52 on the back 16. Crosshatch, vertical and horizontal raised strips and other patterns can be used to form these anti-skid surfaces. Alternatively, the body 12 can be constructed with side and back grooves in various patterns so that the user can apply anti-skid tape of their choice of color, pattern and texture. A further alternative can include discreet sections of the side and back having integrated anti-skid surfaces.

Figure 3B:
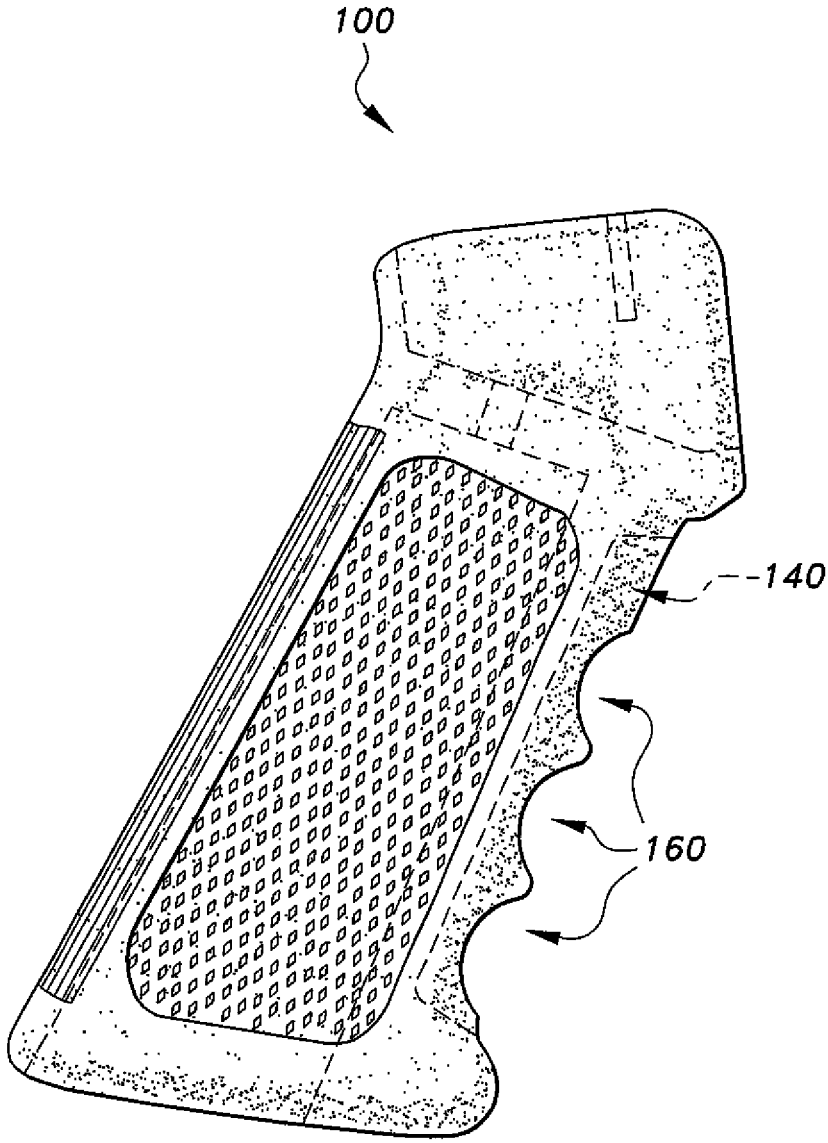
FIG. 3B is a side view of an alternative embodiment of a tactical precision grip according to the present invention.

An alternative embodiment of a tactical precision grip 100 is shown in FIG. 3B. In this embodiment, the tactical precision grip 100 is substantially the same as the previously described tactical precision grip 10. However, the tactical precision grip 100 also includes a plurality of finger grooves 160 on opposite, longitudinal sides of the vertical fingertip groove 140. The finger grooves 160 provide ergonomic depressions for the user to wrap their fingers around the front of the tactical precision grip 100 and insert their fingertips into the fingertip groove 140. Alternatively, a single finger groove can be formed on the front of the tactical precision grip 100 for the middle or trigger finger.

Figure 4:
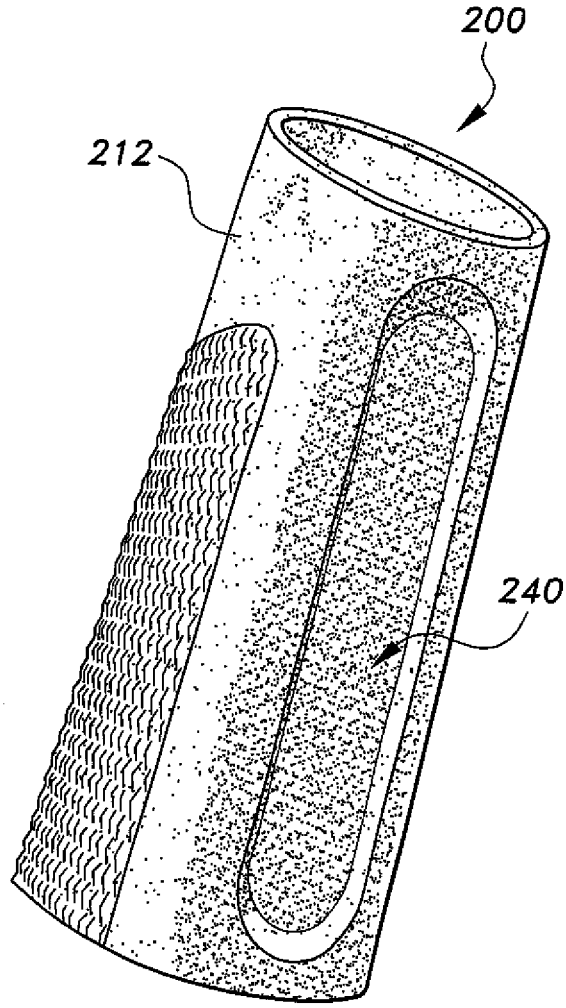
FIG. 4 is a perspective of a further alternative embodiment of a tactical precision grip according to the present invention in the form of a slip-on cover.

A further alternative embodiment of a tactical precision grip 200 is shown in FIG. 4. In this embodiment, the tactical precision grip 200 is constructed as a sleeve that can be wrapped around standard or existing firearm grips. The tactical precision grip 200 includes an elongate, tubular body 212 that includes an elongate, vertical fingertip groove 240 on the front portion of the body 212. The body 212 is preferably constructed from durable elastomeric polymer so that the body 212 can slip onto existing firearm grips without strenuous effort.

Figure 5:
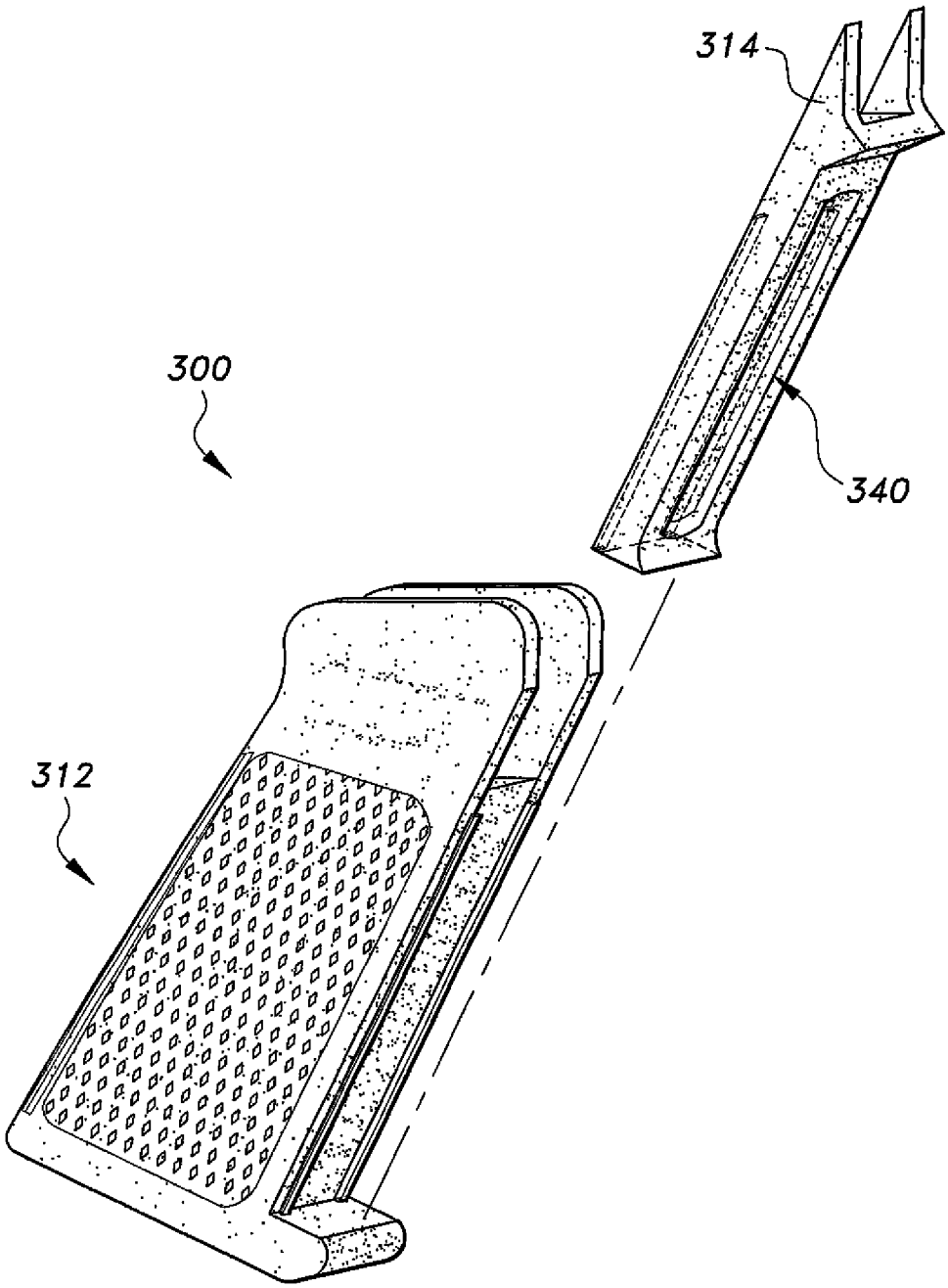
FIG. 5 is a perspective view of a still further alternative embodiment of a tactical precision grip according to the present invention in the form of a selectively mounted front strip having a fingertip groove.

A still further alternative embodiment of a tactical precision grip 300 is shown in FIG. 5. In this embodiment, the tactical precision grip is constructed as a firearm grip system that can be modified according to the user's tastes. As shown, the tactical precision grip 300 includes a main body 312 and a detachable front strip 314. The front strip 314 includes an elongate, vertical fingertip groove 340. The front strip 314 can be selectively installed to the front of the main body 312 to provide the benefits of the fingertip groove 340, e.g., by a rail system. Other front strips with different features, such as the finger grooves 160, can be selectively and interchangeably mounted to the main body 312.

Figure 6:
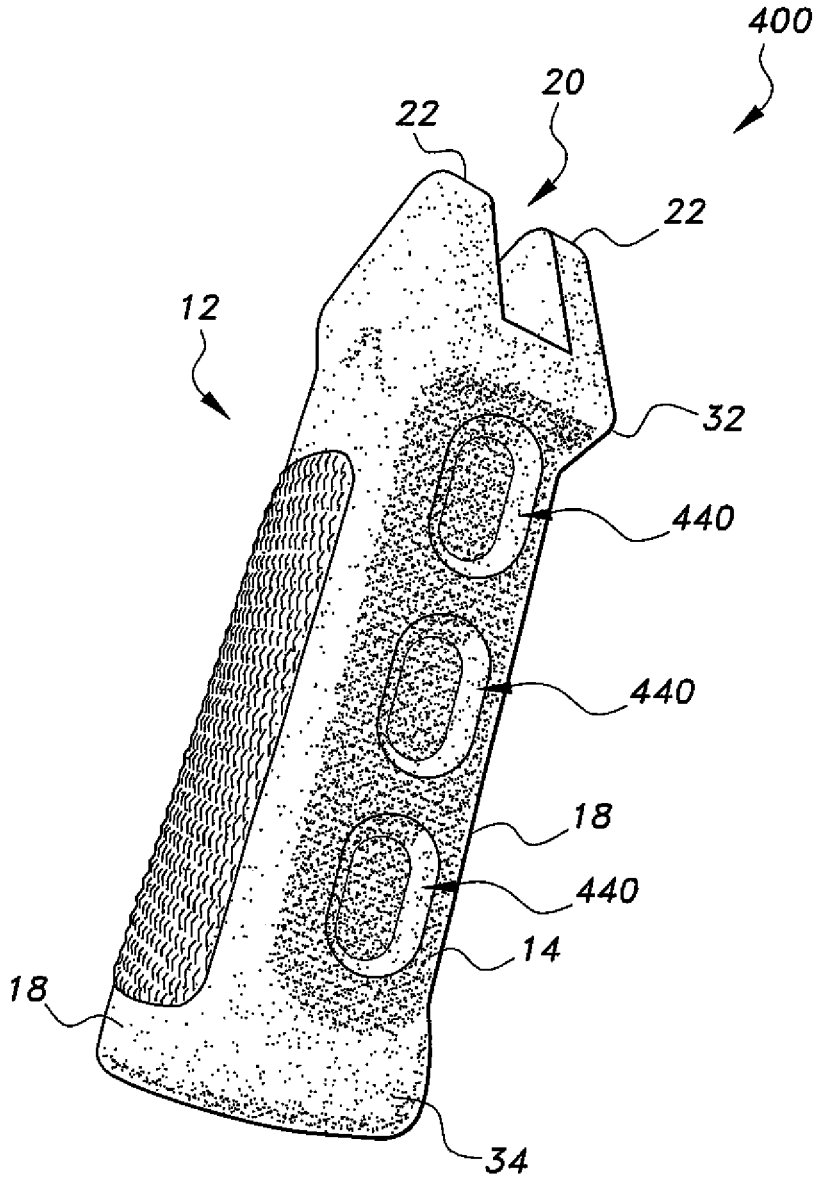
FIG. 6 is a perspective view of yet another further alternative embodiment of a tactical precision grip according to the present invention with a plurality of fingertip indentions.

Another further alternative embodiment of a tactical precision grip 400 is shown in FIG. 6. In this embodiment, the tactical precision grip 400 is substantially the same as the previously described tactical precision grip 10. However, in place of the single, elongate fingertip groove 40, the tactical precision grip 400 is provided with a plurality of fingertip indentions, depressions or grooves 440 along the front. These fingertip grooves 440 permit individual fingertips to be placed therein at ergonomically fixed, spaced locations along the length of the grip 400. During use, the fingertip indentions 440 provide enhanced support for each fingertip, and the user can quickly facilitate proper fingertip placement by tactile feel.

Figure 7:
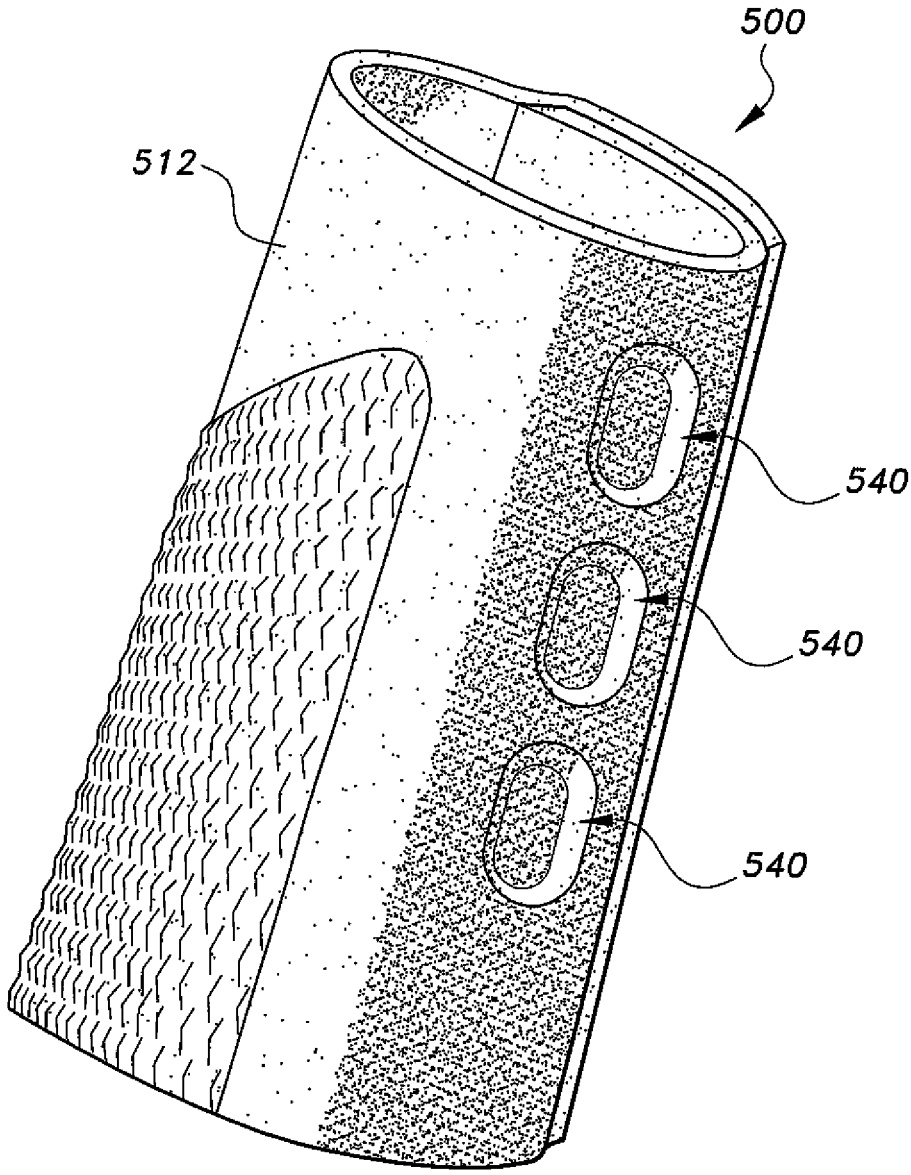
FIG. 7 is a perspective view of yet still another further alternative embodiment of a tactical precision grip according to the present invention with a plurality of fingertip indentions, the grip being a wrap especially for rifle stock grips.

A still further alternative embodiment of a tactical precision grip 500 is shown in FIG. 7. In this exemplary embodiment, the tactical precision grip 500 is configured similar to that of the sleeve discussed above with respect to the tactical precision grip 200 shown in FIG. 4. As such, the tactical precision grip 500 is designed to be slid onto existing handles or grips on firearms. The tactical precision grip 500 can be constructed in a similar manner as the grip 200, in the form of a sleeve having an elongate tubular body 512 with a plurality of fingertip indentions, depressions or grooves 540 disposed along the front thereof. Preferably, the tubular body 512 is formed by a strip of elastic material with overlapping ends that can be selectively attached to each other by fasteners, such as hook and loop fasteners, press-fit fasteners and the like. The overlapped construction is especially easier to install on stock grips of rifles, i.e., non-pistol grips. In the case of pistol grips, the tubular body 512 can be constructed as a continuous tubular sleeve in the same manner as the grip 200.

It is noted that the tactical precision grip 10, 100, 200, 300, 400, 500 encompasses a variety of alternatives. For example, the tactical precision grip 10, 100, 200, 300, 400, 500 can be constructed in various color schemes and patterns to match the color and pattern of existing firearms. The elongate fingertip groove or the plurality of fingertip indentions can be constructed in a variety of shapes as long as they allow for desired placement of the user's fingertips to facilitate application of minimal firearm grip contact.

It is to be understood that the present invention is not limited to the embodiments described above, but encompasses any and all embodiments within the scope of the following claims.

I claim:

1. A tactical precision grip for firearms, comprising:

an elongate, substantially hollow body having a front, a back, opposite sides, an upper mounting portion, a hollow compartment, and an interior partition between the upper mounting portion and the hollow compartment, the interior partition having a through-hole, the upper mounting portion defining a mounting recess adapted for mounting the body to existing mounting hardware of a firearm via a fastener through the through-hole;

an anti-skid surface continuously disposed on at least the back and the opposite sides of the body for preventing inadvertent slip while holding the body;

a portion of the body for placing a user's thumb; and at least one vertically aligned fingertip groove formed along the front of the body for placing the user's fingertips therein, each of the at least one vertically aligned fingertip groove is surrounded by a peripheral wall and confined solely within the boundary of the front of the body;

wherein the portion and the at least one fingertip groove encourage placement of the thumb and fingertips to minimize firearm grip contact, thereby enhancing trigger control for increased shooting accuracy.

2. The tactical precision grip for firearms according to claim 1, wherein said at least one vertically aligned fingertip groove comprises a single vertical elongate fingertip groove.

3. The tactical precision grip for firearms according to claim 2, further comprising at least one elongate strip of non-skid tape disposed in said vertically aligned fingertip groove for minimizing contact slip during use.

4. The tactical precision grip for firearms according to claim 2, further comprising at least one finger groove formed on opposite, longitudinal sides of said vertically aligned fingertip groove, the at least one finger groove defining at least one ergonomic depression for the user to wrap the user's fingers around the front of said body.

5. The tactical precision grip for firearms according to claim 4, wherein said at least one finger groove comprises a plurality of finger grooves.

6. The tactical precision grip for firearms according to claim 4, further comprising at least one elongate strip of non-skid tape disposed in said vertically aligned fingertip groove for minimizing contact slip during use.

7. The tactical precision grip for firearms according to claim 2, wherein the front of said body comprises an elongate, detachable front strip, said front strip having said vertically aligned fingertip groove formed thereon.

8. The tactical precision grip for firearms according to claim 2, further comprising an upper protrusion and a lower protrusion extending from the front of said body, said upper and lower protrusions forming upper and lower abutments for placing the user's fingers therebetween, said vertically aligned fingertip groove being disposed between said upper protrusion and said lower protrusion.

9. The tactical precision grip for firearms according to claim 1, wherein said at least one vertically aligned fingertip groove comprises a plurality of fingertip grooves disposed in a vertical column along the front of said body.

10. A tactical precision grip for firearms, comprising:

an elongate, substantially hollow body having a front, a back, opposite sides, and an opening for sliding the body over an existing grip of a firearm;

anti-skid surfaces disposed on at least the back and the opposite sides of the body for preventing inadvertent slip while holding the body; and at least one vertically aligned fingertip groove formed along the front of the body for placing the user's fingertips therein, each of the at least one vertically aligned fingertip groove having a depression surrounded by a peripheral wall and being confined solely within the boundary of the front of the body;

wherein the at least one fingertip groove encourages placement of the fingertips to minimize firearm grip contact, thereby enhancing trigger control for increased shooting accuracy.

11. The tactical precision grip for firearms according to claim 10, wherein said at least one vertically aligned fingertip groove comprises a single vertical, elongate fingertip groove.

12. The tactical precision grip for firearms according to claim 10, wherein said at least one vertically aligned fingertip groove comprises a plurality of fingertip grooves disposed in a vertical column along the front of said body.

13. The tactical precision grip for firearms according to claim 1, wherein the portion of the body for placing a user's thumb includes a depression defined on an upper portion of the back of the body.

14. The tactical precision grip for firearms according to claim 1, wherein the portion of the body for placing a user's thumb includes a depression defined on an upper portion of each one of the opposite sides of the body.

15. A method for accurate shooting of firearms, comprising the steps of:

providing a tactical precision grip having:

an elongate, substantially hollow body having a front, a back, opposite sides, an upper mounting portion, a hollow compartment, and an interior partition between the upper mounting portion and the hollow compartment, the interior partition having a through-hole, the upper mounting portion defining a mounting recess adapted for mounting the body to existing mounting hardware of a firearm via a fastener through the through-hole;

anti-skid surfaces disposed on at least the back and the opposite sides of the body for preventing inadvertent slip while holding the body;

a depression defined on an upper portion of the back of the body for placing a user's thumb; and at least one fingertip groove vertically formed and aligned along the front of the body for placing the user's fingertips therein, each of the at least one fingertip groove having a depression surrounded by a peripheral wall and being confined solely within the boundary of the front of the body;

removing an existing grip from the existing mounting hardware of a firearm;

mounting the body onto the existing mounting hardware;

inserting the fastener through the through-hole;

placing the user's thumb on the depression;

wrapping the user's hand around one of the sides of the body;

placing the user's fingertips inside the vertical fingertip groove;

placing the user's trigger finger on a trigger of the firearm;

aiming the firearm at the target; and pulling the trigger straight back with even pressure.

* * * * *